US010807817B2

(12) United States Patent
Sato

(10) Patent No.: US 10,807,817 B2
(45) Date of Patent: Oct. 20, 2020

(54) SHEET STORAGE CASSETTE AS WELL AS SHEET FEEDER AND IMAGE FORMING APPARATUS PROVIDED WITH THE SAME

(71) Applicant: KYOCERA Document Solutions Inc., Osaka (JP)

(72) Inventor: Takehiro Sato, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 19 days.

(21) Appl. No.: 16/235,472

(22) Filed: Dec. 28, 2018

(65) Prior Publication Data

US 2019/0233227 A1 Aug. 1, 2019

(30) Foreign Application Priority Data

Jan. 31, 2018 (JP) ..... 2018-014986

(51) Int. Cl.
*B65H 1/26* (2006.01)
*A47B 88/427* (2017.01)

(52) U.S. Cl.
CPC ..... *B65H 1/266* (2013.01); *A47B 88/427* (2017.01); *B65H 2402/33* (2013.01); *B65H 2402/343* (2013.01); *B65H 2405/32* (2013.01)

(58) Field of Classification Search
CPC ..... B65H 1/266; B65H 2405/32; B65H 2405/33; B65H 2402/343; A47B 88/427; A47B 88/0422; A47B 88/407; A47B 88/0407; A47B 88/423; A47B 88/0418; A47B 88/4276; A47B 88/0433; A47B 88/4274; A47B 88/0429; A47B 88/4278; A47B 88/0437; A47B 88/4272; A47B 88/0425

See application file for complete search history.

(56) References Cited

U.S. PATENT DOCUMENTS 5,632,542 A * 5/1997 Krivec ..... A47B 88/427 312/334.7
7,967,399 B1 * 6/2011 Baiza ..... A47B 88/427 312/223.1
10,154,731 B2 * 12/2018 Chen ..... A47B 88/40
(Continued)

FOREIGN PATENT DOCUMENTS

JP 2007-217185 A 8/2007
JP 2014-46045 A 3/2014

*Primary Examiner* — Patrick Cicchino
(74) *Attorney, Agent, or Firm* — Stein IP, LLC

(57) ABSTRACT

A sheet storage cassette includes a cassette base and inner rails. The cassette base has side plates facing each other parallel to insertion/withdrawal directions of the sheet storage cassette. The inner rails each have positioning bosses that protrude from each of different positions on the inner rails in a longitudinal direction thereof and a hook portion that protrudes in an L-shape in cross section toward the cassette base and is formed between the positioning bosses. On the side plates of the cassette base, there are provided mounting holes that receive the positioning bosses fitted thereinto at the time of mounting the cassette base to the inner rails, positioning surfaces that comes into contact with two locations on each of the inner rails in a longitudinal direction thereof, and fitted portions that are fitted together with the hook portion in a direction orthogonal to the insertion/withdrawal directions.

5 Claims, 8 Drawing Sheets

(56) References Cited

U.S. PATENT DOCUMENTS

| | | | | |
|---|---|---|---|---|
| 2008/0001342 | A1* | 1/2008 | Matsushima | B65H 1/14<br>271/3.14 |
| 2014/0062282 | A1 | 3/2014 | Nishioka | 312/334.44 |

* cited by examiner

SHEET STORAGE CASSETTE AS WELL AS SHEET FEEDER AND IMAGE FORMING APPARATUS PROVIDED WITH THE SAME

INCORPORATION BY REFERENCE

This application is based upon and claims the benefit of priority from the corresponding Japanese Patent Application No. 2018-014986, filed on Jan. 31, 2018, the contents of which are incorporated herein by reference.

BACKGROUND

The present disclosure relates to a sheet storage cassette having a cassette base in which a sheet-shaped recording medium is loaded and stored, as well as a sheet feeder and an image forming apparatus provided with the same.

In an image forming apparatus such as a copy machine, a printer, or a facsimile, a sheet storage cassette capable of appropriately loading variously sized sheets (sheets) therein is provided so as to be insertable/removable into/from a main body of the image forming apparatus.

The sheet storage cassette is mounted so as to be insertable into and drawable out of the main body of the image forming apparatus by use of a slide rail having an outer rail provided in the main body of the image forming apparatus and an inner rail provided on the sheet storage cassette.

For example, there is known a paper feed cassette provided with a slide rail that is slidably coupled to a rail installed in a main body of an image forming apparatus, a sheet placing portion that is secured to the slide rail and configured to place a sheet thereon, a metallic lift plate for lifting the sheet thus placed, which is provided on a placing surface of the sheet placing portion, and a conduction member that, at least when the paper feed cassette is drawn out of the main body and when the paper feed cassette is housed in the main body, provides electrical conduction between the lift plate and the main body via the slide rail or a main body electrical conduction portion that is provided on an inner side surface of the main body, which forms a space in which the paper feed cassette is housed.

Furthermore, there is known a slide rail provided with a stationary rail that is substantially C-shaped in cross section, a ball retainer that is provided in the stationary rail, has ball bearings disposed on both sides of the stationary rail, and is freely slidable in a length direction of the stationary rail, and a moving rail that is disposed in the stationary rail and mounted to the ball retainer so as to be freely slidable relative to the ball retainer by use of the ball bearings. The moving rail is configured to be insertable/withdrawable into/from the stationary rail by being drawn out to a near side of the stationary rail and demounted from the ball retainer or by being inserted from the near side into the ball retainer. A plurality of ball retainers are provided in the length direction of the stationary rail, one of which serves as a guide retainer disposed at an end portion of the stationary rail on the near side.

SUMMARY

A sheet storage cassette according to one aspect of the present disclosure is provided with a cassette base and inner rails and is insertable/withdrawable into/from a cassette housing portion. The cassette base has side plates facing each other parallel to insertion/withdrawal directions of the sheet storage cassette and stores a sheet-shaped recording medium therein. The inner rails are mountable/demountable to/from the side plates of the cassette base and are slidably coupled to outer rails that are secured to the cassette housing portion. The inner rails each have positioning bosses and a hook portion. The positioning bosses protrude from each of different positions on a side surface of the inner rails in a longitudinal direction thereof. The hook portion protrudes in an L-shape in cross section toward the cassette base, and are formed between the positioning bosses, and on each of the side surface of the inner rails. Mounting holes, positioning surfaces, and fitted portions are provided on the side plates of the cassette base. The mounting holes receive the positioning bosses fitted thereinto at the time of mounting the cassette base to the inner rails. In a fitted state where the mounting holes and the positioning bosses are fitted together, the positioning surfaces come into contact with two locations on each of the inner rails in a longitudinal direction thereof, thus performing positioning of the cassette base with respect to the inner rails in a direction orthogonal to the insertion/withdrawal directions. The fitted portions are fitted together with the hook portion in the direction orthogonal to the insertion/withdrawal directions in the fitted state.

Still other objects of the present disclosure and specific advantages provided by the present disclosure will be made further apparent from the following description of an embodiment.

DETAILED DESCRIPTION

Figure 1:
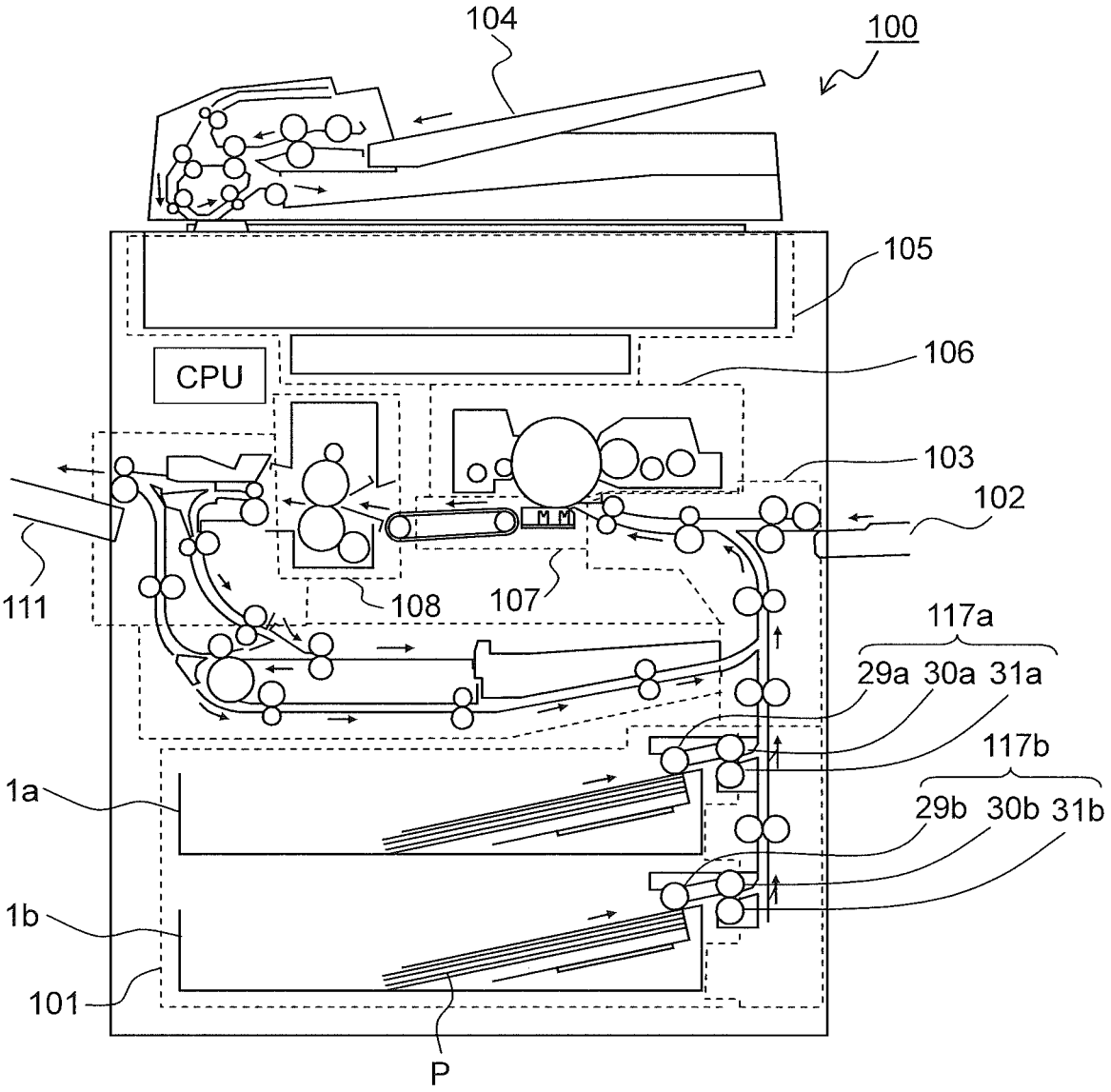
FIG. 1 is a schematic sectional view showing an internal structure of an image forming apparatus provided with a paper feed cassette according to one embodiment of the present disclosure.

With reference to the appended drawings, the following describes an embodiment of the present disclosure. FIG. 1 is a side sectional view showing an internal structure including paper feed cassettes 1*a* and 1*b* according to one embodiment of the present disclosure. A solid line arrow in this figure indicates a conveyance path and a conveyance direction of a sheet P.

In FIG. 1, a cassette housing portion 101 is disposed in a lower portion of an image forming apparatus 100. The two paper feed cassettes (sheet storage cassettes) 1*a* and 1*b* are provided in the cassette housing portion 101. Inside each of the paper feed cassettes 1*a* and 1*b*, a stack of sheets P of cut paper or the like before being printed is loaded and stored, and the sheet P is fed one by one separately from the stack of sheets P by a corresponding one of paper feed units 117*a* and 117*b* provided in a main body of the image forming apparatus 100.

The paper feed unit 117*a* has a pick-up roller 29*a*, a feed roller 30*a*, and a retard roller 31*a* brought into press-contact with the feed roller 30*a*, which are provided so as to correspond to the paper feed cassette 1*a*. The paper feed unit 117*b* has a pick-up roller 29*b*, a feed roller 30*b*, and a retard roller 31*b* brought into press-contact with the feed roller 30*b*, which are provided so as to correspond to the paper feed cassette 1*b*.

A manual paper feed portion 102 is provided outside an upper right side surface of the image forming apparatus 100. A medium fed one by one such as a sheet different in size and thickness from a sheet stored in the cassette housing portion 101, an OHP sheet, an envelope, a postcard, an invoice, or the like is placed on the manual paper feed portion 102.

A sheet conveyance portion 103 is disposed in the image forming apparatus 100. The sheet conveyance portion 103 is positioned on a right side, which is a downstream side in a paper feed direction with respect to the cassette housing portion 101, and positioned on a left side, which is a downstream side in a paper feed direction with respect to the manual paper feed portion 102. By the sheet conveyance portion 103, the sheet P fed from the cassette housing portion 101 is conveyed perpendicularly upward along a side surface of the main body of the image forming apparatus 100, and the sheet P fed from the manual paper feed portion 102 is conveyed horizontally.

An auto document feeder 104 is disposed on an upper surface of the image forming apparatus 100, and an image reading portion 105 is disposed below the auto document feeder 104. In copying an original document, a plurality of original documents are loaded on the auto document feeder 104. In the auto document feeder 104, each of the original documents is fed one by one separately, and image data thereof is read by the image reading portion 105.

An image forming portion 106 and a transfer portion 107 are disposed on a downstream side in a sheet conveyance direction of the sheet conveyance portion 103 and below the image reading portion 105. In the image forming portion 106, based on the image data read by the image reading portion 105, an electrostatic latent image of an original document image is formed, and the electrostatic latent image is developed into a toner image. Meanwhile, in synchronization with timing for forming the toner image at the image forming portion 106, the sheet P is conveyed from the cassette housing portion 101 to the transfer portion 107 via the sheet conveyance portion 103. The toner image formed at the image forming portion 106 is transferred on the sheet P at the transfer portion 107.

A fixing portion 108 is disposed on a downstream side of the transfer portion 107. The sheet P on which the toner image has been transferred at the transfer portion 107 is conveyed to the fixing portion 108 where it is passed through a nip portion of a fixing roller pair composed of a heating roller and a pressing roller, and thus the toner image on the sheet P is fixed into a permanent image. The sheet P discharged from the fixing portion 108 is discharged onto a sheet discharge tray 111 provided outside a left side surface of the image forming apparatus 100.

Figure 2:
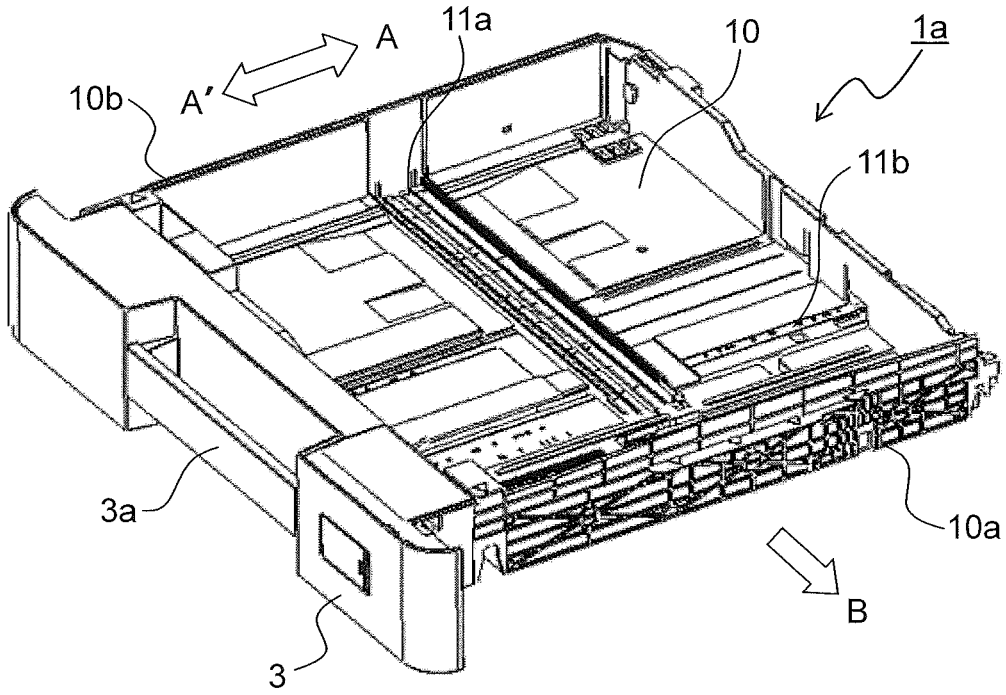
FIG. 2 is an outer appearance perspective view of the paper feed cassette of the embodiment as seen from above.

Next, a description is given of a detailed configuration of the paper feed cassette 1*a* that is mountable/demountable into/from the image forming apparatus 100. FIG. 2 is an outer appearance perspective view of the paper feed cassette 1*a* as seen from above on a forward surface side thereof. While the description here is directed to the configuration of the paper feed cassette 1*a*, a configuration of the paper feed cassette 1*b* is exactly the same as that of the paper feed cassette 1*a*. Furthermore, in FIG. 2, with respect to the cassette housing portion 101, an arrow A indicates an insertion direction of the paper feed cassette 1*a*, an arrow A' indicates a draw-out direction thereof, and an arrow B indicates the paper feed direction from the paper feed cassette 1*a*.

The paper feed cassette 1*a* is housed in the cassette housing portion 101 of the image forming apparatus 100 shown in FIG. 1. A cassette base 10 that is a main body portion of the paper feed cassette 1*a* is formed of a flat box whose upper surface is open, and the sheet P loaded and stored therein from an upper surface direction thereof. In the cassette housing portion 101 inside the image forming apparatus 100, the paper feed unit 117*a* (see FIG. 1) is provided on an upper side of the paper feed cassette 1*a*, and the sheet P (see FIG. 1) is fed in an arrow B direction shown in FIG. 2. A cassette cover 3 is attached to a forward surface portion of the cassette base 10. A front surface side (a left near side in FIG. 2) of the cassette cover 3 is exposed to the outside, constituting part of an exterior surface of the main body of the image forming apparatus 100. The cassette cover 3 is provided with a grasping portion 3*a* to be grasped at the time of inserting/withdrawing the paper feed cassette 1*a* into/from the cassette housing portion 101.

The paper feed cassette 1*a* is inserted into the cassette housing portion 101 by engaging a mounting hole 20 (see FIG. 6) with a positioning boss 47 (see FIG. 5) of a slide rail 40 provided in the cassette housing portion 101 and being slid horizontally in an arrow A direction shown in FIG. 2. The mounting hole 20 is provided outside each of side plates 10*a* and 10*b* of the cassette base 10 parallel to an insertion/withdrawal direction (an arrow A-A' direction).

Inside the cassette base 10, there are provided a sheet loading plate on which the sheet P is loaded, a pair of width regulation cursors that perform positioning of the sheet P loaded on the sheet loading plate in a width direction thereof, and a rear end cursor that is disposed at a position corresponding to a size of the sheet P so as to align a rear end of the sheet P loaded on the sheet loading plate (none of these are shown). Since the sheet P is fed out in the arrow B direction toward the sheet conveyance portion 103 (see FIG. 1), the rear end cursor that aligns the rear end of the sheet P is provided so that it can reciprocate parallel to the paper feed direction (the arrow B direction) along a cursor guide groove 11*a* formed in the cassette base 10. Furthermore, the pair of width regulation cursors that perform positioning of the sheet P in the width direction are provided so that they can reciprocate in a direction (the arrow A-A' direction) orthogonal to the paper feed direction along a cursor guide groove 11*b* formed in the cassette base 10.

Figure 3:
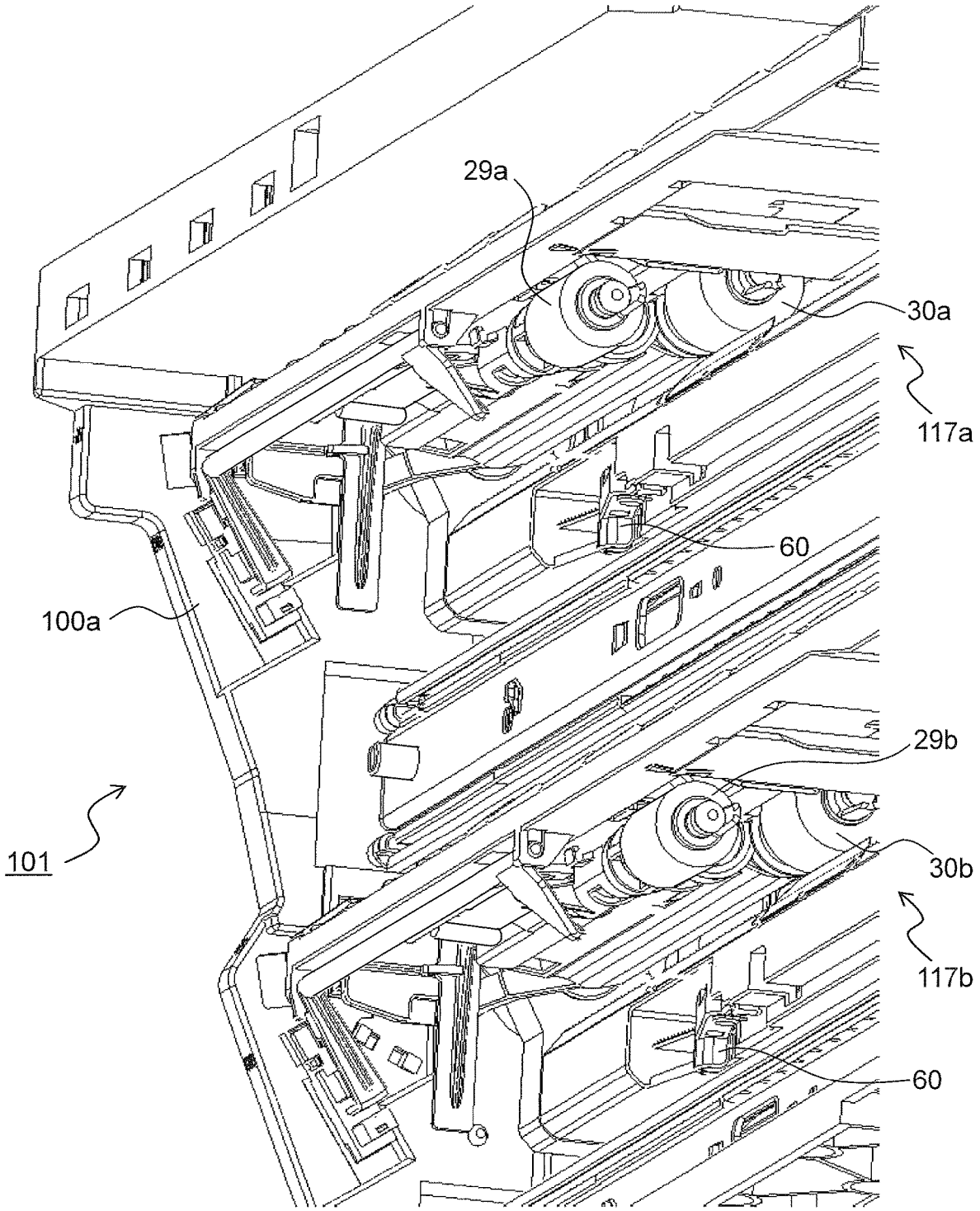
FIG. 3 is a partial perspective view of paper feed units as seen from a cassette insertion direction.

FIG. 3 is a partial perspective view of the paper feed units 117*a* and 117*b* (the sheet feed units) as seen from a cassette insertion direction. As shown in FIG. 3, the paper feed units 117*a* and 117*b* are supported so as to be mountable/demountable into/from the cassette housing portion 101 formed between a pair of side surface frames 100*a* and 100*b* (the side surface frame 100*b* on a front surface side is not shown in FIG. 3) oppositely disposed on a back surface side and the front surface side of the image forming apparatus 100.

A retard lever 60 is provided below each of the pick-up rollers 29*a* and 29*b*. The paper feed cassettes 1*a* and 1*b* are mounted into the cassette housing portion 101 and thus press the retard levers 60, permitting the retard rollers 31*a* and 31*b* (see FIG. 1) to move toward the feed rollers 30*a* and 30*b*, respectively, so that the feed roller 30*a* comes into contact with the retard roller 31*a*, and the feed roller 30*b* comes into contact with the retard roller 31*b*, thus forming paper feed roller pairs.

Figure 4:
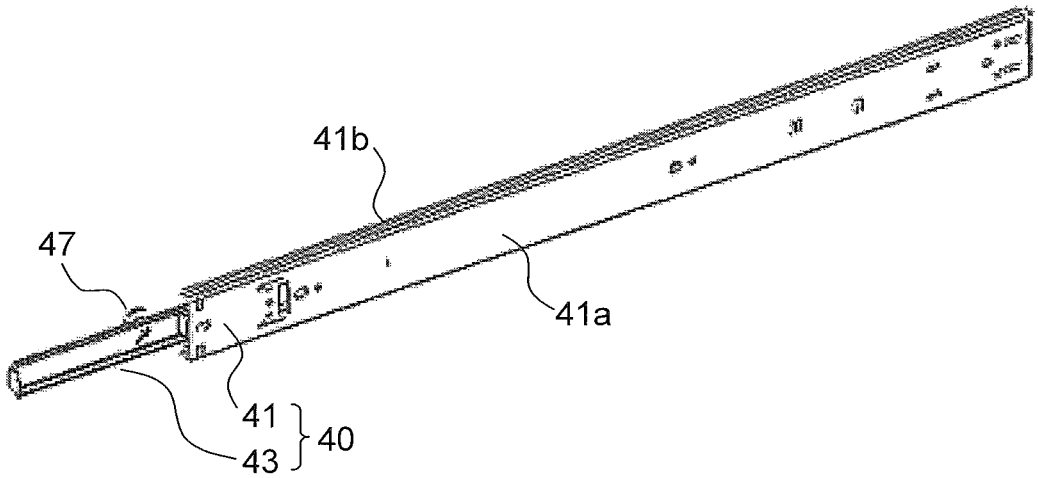
FIG. 4 is a perspective view of a slide rail provided in a cassette housing portion as seen from a front surface side (a cassette housing portion side).
Figure 5:
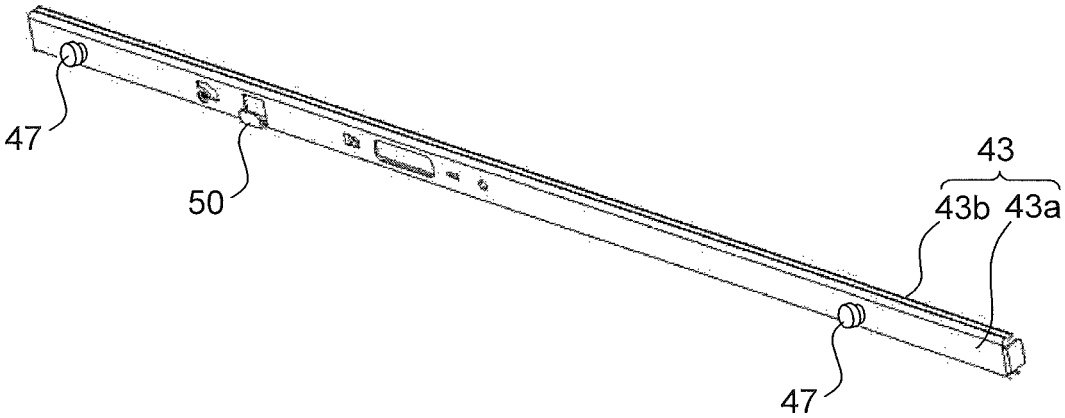
FIG. 5 is a perspective view of an inner rail that is a component of the slide rail as seen from a rear surface side (a paper feed cassette side).

FIG. 4 is a perspective view of the slide rail 40 provided in the cassette housing portion 101 as seen from a front surface side (a cassette housing portion 101 side), and FIG. 5 is a perspective view of an inner rail 43 that is a component of the slide rail 40 as seen from a rear surface side (a paper feed cassette 1*a* side). The slide rail 40 is made of metal and has an outer rail 41 that is secured to the cassette housing portion 10 and the inner rail 43 that is slidably inserted into the outer rail 41. The inner rail 43 is mountable/demountable to/from the side plates 10*a* and 10*b* of the cassette base 10.

The outer rail 41 has an elongated plate-shaped main body portion 41*a* and a bent edge 41*b* formed by bending each of both side ends of the main body portion 41*a* in a longitudinal direction thereof to the rear surface side. The outer rail 41 has a substantially C-shaped sectional shape in a direction orthogonal to the longitudinal direction.

The inner rail 43 has an elongated plate-shaped main body portion 43*a* formed so as to have a length substantially equal to that of the outer rail 41 and a bent edge 43*b* formed by bending each of both side ends of the main body portion 43*a* in a longitudinal direction thereof to the front surface side. The inner rail 43 has a sectional shape in a direction orthogonal to the longitudinal direction, which is substantially C-shaped in an opposite direction to that of the outer rail 41.

On an inner side of each of the bent edges 41*b* and 41*b* of the outer rail 41, there is disposed a ball bearing (not shown) rotatably retaining a plurality of balls arranged at prescribed spacings along the longitudinal direction. The ball bearing is opposed to an outer side surface of the bend edge 43*b* of the inner rail 43. The balls of the ball bearing roll between the bent edge 41*b* and the bent edge 43*b*, and thus the inner rail 43 is retained so as to be slidable with respect to the outer rail 41. Furthermore, a come-off prevention mechanism (not shown) for preventing the inner rail 43 from coming off the outer rail 41 is provided at an end portion of the inner rail 43 on a downstream side in a direction in which the inner rail 43 is inserted into the outer rail 41.

The inner rail 43 has the positioning boss 47 protruding to the rear surface side from each of two locations on the main body portion 43*a* in a vicinity of both end portions thereof in the longitudinal direction. The positioning boss 47 engages with the mounting hole 20 (see FIG. 6) provided on each of the side plates 10*a* and 10*b* of the cassette base 10.

Furthermore, in the main body portion 43*a* of the inner rail 43, a hook portion 50 is provided between the positioning bosses 47 at the two locations. The hook portion 50 protrudes in an L-shape as viewed in cross section from the main body portion 43*a* to the rear surface side.

Figure 6:
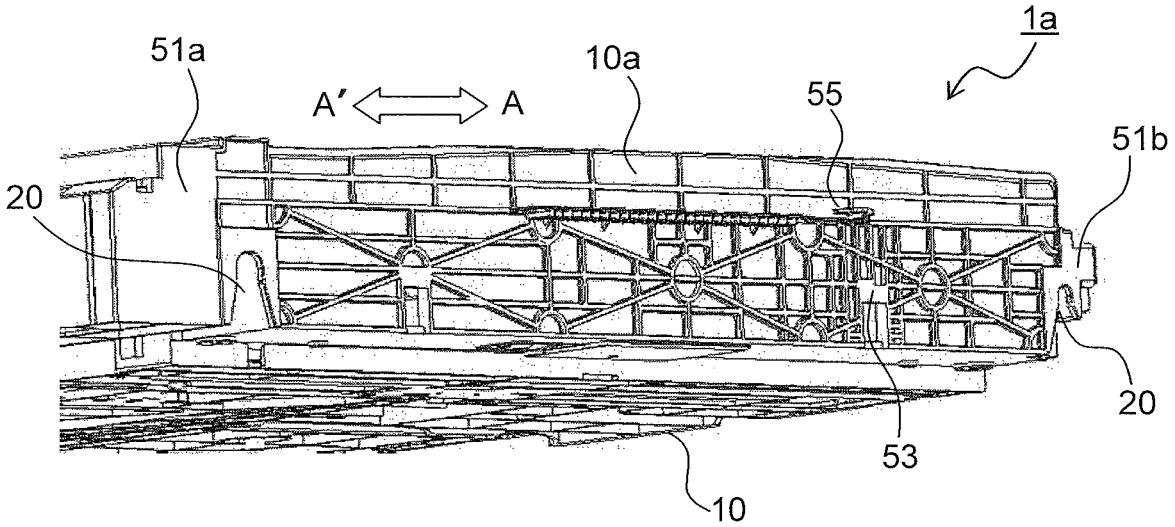
FIG. 6 is a partial perspective view of the paper feed cassette as seen from a side surface side.
Figure 7:
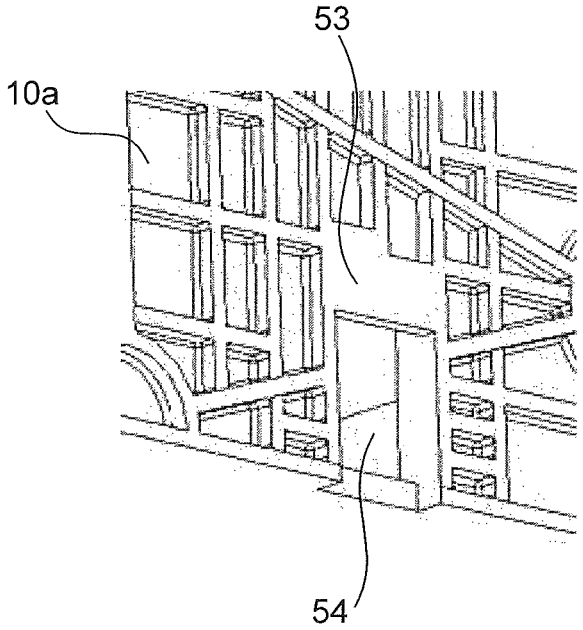
FIG. 7 is an enlarged perspective view of a vicinity of a fitted portion shown in FIG. 6.

FIG. 6 is a partial perspective view of the paper feed cassette 1*a* as seen from a side surface 10*a* side, and FIG. 7 is an enlarged perspective view of a vicinity of a fitted portion 53 shown in FIG. 6. The mounting hole 20 for mounting the paper feed cassette 1*a* to the inner rail 43 is provided at each of two locations on the side plates 10*a* of the cassette base 10. The mounting hole 20 is formed in an invert U shape.

The paper feed cassette 1*a* is mounted to the inner rail 43 by following a procedure below. That is, first, the inner rail 43 is drawn out of the outer rail 41, and the positioning bosses 47 of the inner rail 43 are inserted respectively into the mounting holes 20 formed on the side plate 10*a* of the cassette base 10 so that the paper feed cassette 1*a* is mounted. This makes it possible to easily mount the sheet cassette 1*a* without using any screw or tool. Furthermore, the mounting holes 20 engage with the positioning bosses 47, respectively, and thus positioning of the cassette base 10 with respect to the inner rail 43 in the insertion/withdrawal direction (the arrow A-A' direction) is achieved.

Positioning surfaces 51*a* and 51*b* are provided in vicinities of the mounting holes 20, respectively. When the positioning bosses 47 of the inner rail 43 engage with the mounting holes 20, respectively, the main body portion 43*a* comes into contact with the positioning surfaces 51*a* and 51*b*.

The fitted portion 53 to be engaged with the hook portion 50 of the inner rail 43 is provided on the side plate 10*a* of the cassette base 10. As shown in FIG. 7, an opening portion 54 into which the hook portion 50 is to be inserted is provided on a lower side of the fitted portion 53. A pressing rib 55 that presses the retard lever 60 (see FIG. 3 and FIG. 9) provided in the cassette housing portion 101 is provided on an upper side of the fitted portion 53. The fitted portion 53 is provided at a position overlapping the pressing rib 55 in the insertion/withdrawal direction (the arrow A-A' direction) of the paper feed cassette 1*a*.

Figure 8:
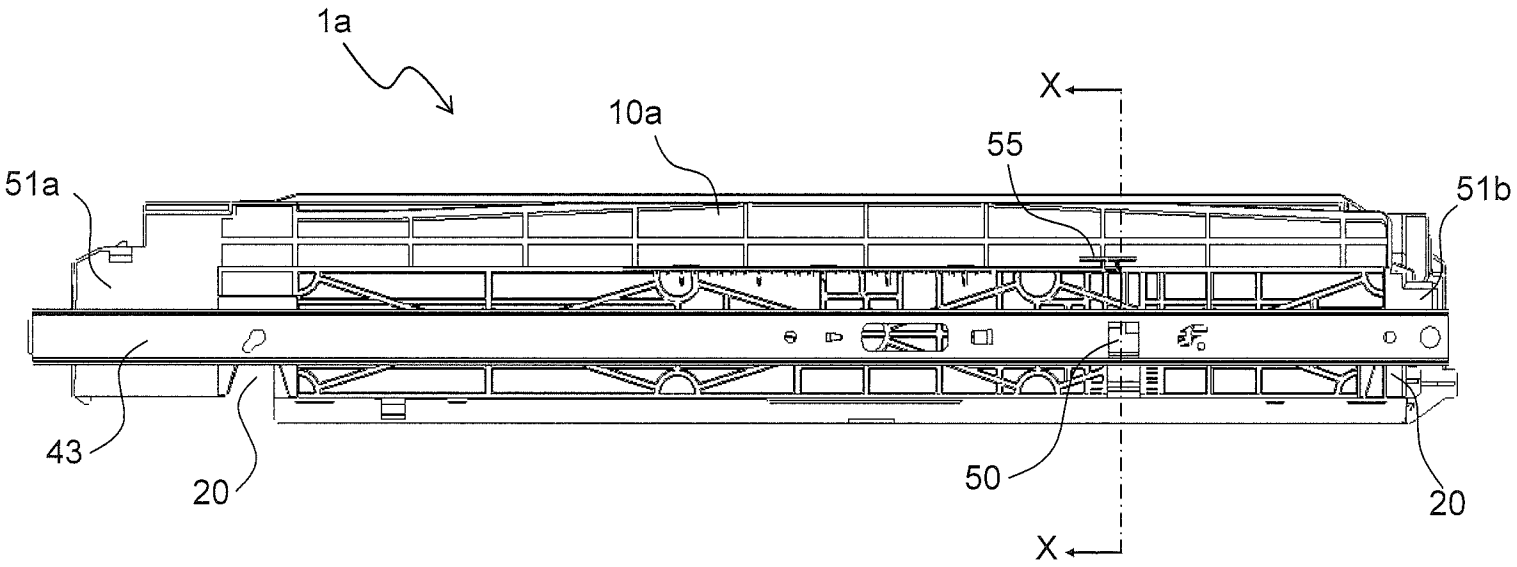
FIG. 8 is a side view of the paper feed cassette showing a state where the inner rail has been mounted to a side plate of a cassette base.
Figure 9:
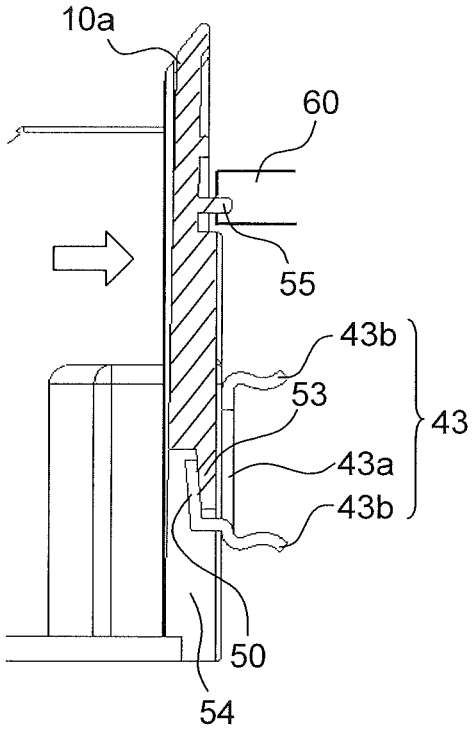
FIG. 9 is a sectional view of the side plate of the cassette base to which the inner rail has been mounted.

FIG. 8 is a side view of the paper feed cassette 1*a* showing a state where the inner rail 43 has been mounted to the side plate 10*a* of the cassette base 10, and FIG. 9 is a sectional view (a sectional view in a direction of an arrow X-X in FIG. 8) of the side plate 10*a* of the cassette base 10 to which the inner rail 43 has been mounted. While FIG. 8 and FIG. 9 illustrate a configuration on the side plate 10*a* side of the cassette base 10, a configuration on a side plate 10*b* side thereof is exactly the same as that on the side plate 10*a* side, a description of which, therefore, is omitted.

In assembling the image forming apparatus 100, the mounting holes 20 provided on each of the side plates 10*a* and 10*b* of the cassette base 10 are fitted respectively over the positioning bosses 47 of the inner rail 43 that has been drawn out of the outer rail 41. This achieves positioning of the cassette base 10 with respect to the inner rail 43 in the insertion/withdrawal direction (the arrow A-A' direction). Furthermore, when the positioning bosses 47 are fitted respectively into the mounting holes 20, a rear side surface of the inner rail 43 comes into contact with the positioning surfaces 51*a* and 51*b* of the side plate 10*a*. This achieves positioning of the cassette base 10 with respect to the inner rail 43 in a direction orthogonal to the insertion/withdrawal direction.

Moreover, as shown in FIG. 9, the hook portion 50 having an L-shape as viewed in cross section and protruding on the rear side surface of the inner rail 43 is fitted together with the fitted portion 53 via the opening portion 54 formed in the side plate 10*a*. The hook portion 50 has a substantially perpendicular fitting surface 50*a* (see FIG. 12) that holds, between itself and the main body portion 43*a*, the fitted portion 53 provided on each of the side plates 10*a* and 10*b* of the cassette base 10. That is, in addition to the positioning surfaces 51*a* and 51*b*, there is provided another fitting shape for performing positioning of the side plate 10*a* and the inner rail 43 in a plane direction (a left-right direction in FIG. 9).

Figure 10:
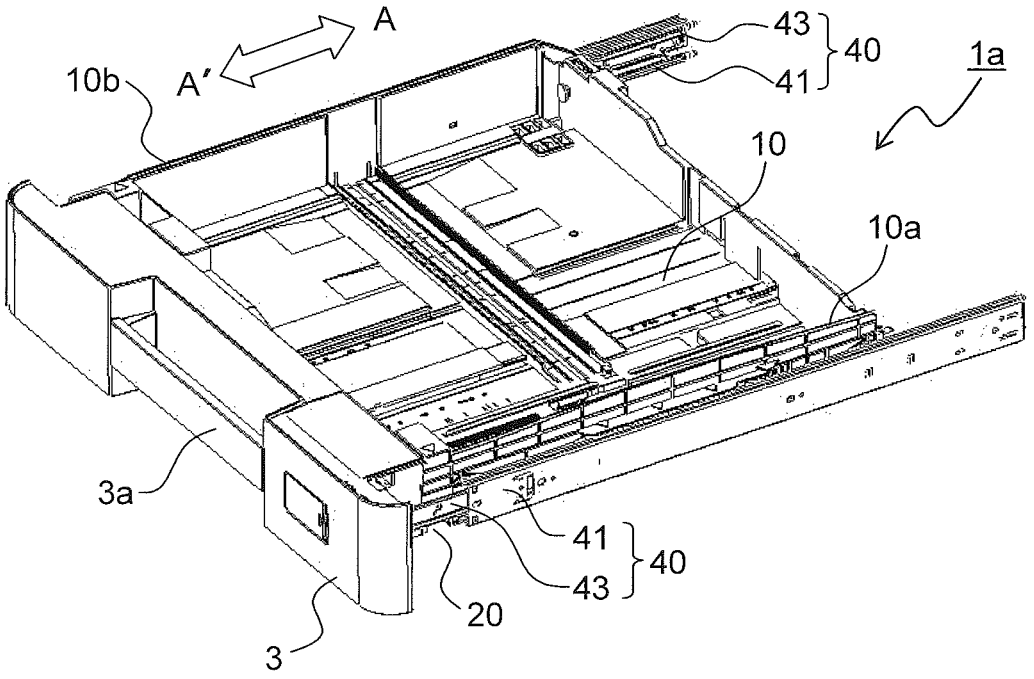
FIG. 10 is a perspective view showing a state where the paper feed cassette is being inserted/withdrawn into/from the cassette housing portion.
Figure 11:
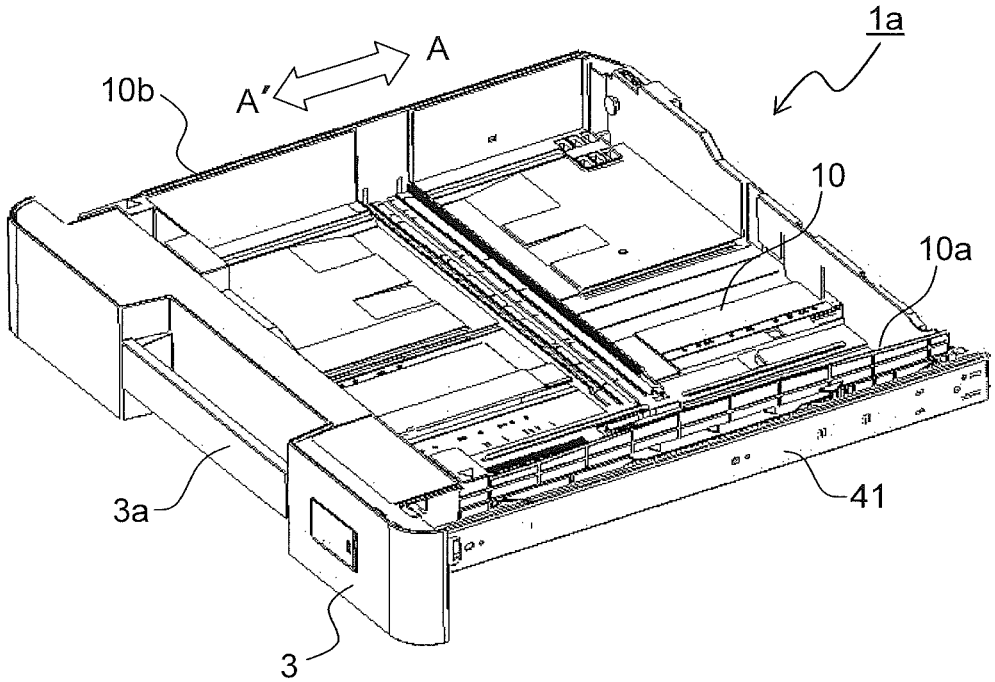
FIG. 11 is a perspective view showing a state where the paper feed cassette has been inserted as far as a paper feed position in the cassette housing portion.

FIG. 10 is a perspective view showing a state where the paper feed cassette 1*a* is being inserted/withdrawn into/from the cassette housing portion 101, and FIG. 11 is a perspective view showing a state where the paper feed cassette 1*a* has been inserted as far as a paper feed position in the cassette housing portion 101. As shown in FIG. 10, when the paper feed cassette 1*a* is inserted into the cassette housing portion 101, the inner rail 43 is inserted into the outer rail 41. When the paper feed cassette 1*a* is inserted as far as a prescribed position (the paper feed position) in the cassette housing portion 101, as shown in FIG. 11, the inner rail 43 is brought to a state of being completely housed in the outer rail 41.

When the paper feed cassette 1*a* is inserted as far as the paper feed position, the pressing rib 55 provided on the side plate 10*a* of the cassette base 10 presses the retard lever 60 (see FIG. 9) provided in the cassette housing portion 101. When the retard lever 60 is pressed, the retard roller 31*a* (see FIG. 1) is pressed upward by a retard contact-separation mechanism (not shown) and thus comes into contact with the feed roller 30*a*.

According to this embodiment, the hook portion 50 of the inner rail 43 is fitted together with the fitted portion 53 of the side plate 10*a*, so that the side plate 10*a* of the cassette base 10 is pulled outward (an arrow direction in FIG. 9) by the inner rail 43, and thus inward leaning of the side plate 10*a* is suppressed. Accordingly, it is possible to secure strength of the side plate 10*a* without using any auxiliary member, thus improving accuracy in positioning of the side plate 10*a*. Moreover, a positional relationship between the sheet P stored in the cassette base 10 and the paper feed unit 117*a* provided in the cassette housing portion 101 is also stabilized, and thus occurrence of a paper feed failure can be suppressed.

Furthermore, the fitted portion 53 to be fitted together with the hook portion 50 is provided at a position overlapping the pressing rib 55 in the insertion/withdrawal direction of the paper feed cassette 1*a*, and thus accuracy in positioning of the side plate 10*a* particularly in a vicinity of the pressing rib 55 is improved. Accordingly, when the paper feed cassette 1*a* is inserted as far as the paper feed position, the retard lever 60 can be reliably pressed by the pressing rib 55.

Meanwhile, in a case of demounting the paper feed unit 117*a* in the cassette housing portion 101 for the purpose of maintenance or a case of clearing a jam that has occurred in the cassette housing portion 101, in a state where the paper feed cassette 1*a* is drawn out to a maximum extent, the cassette base 10 is lifted upward so as to release fitting between the mounting holes 20 and the positioning bosses 47, and then the cassette base 10 is demounted from the inner rail 43.

Figure 12:
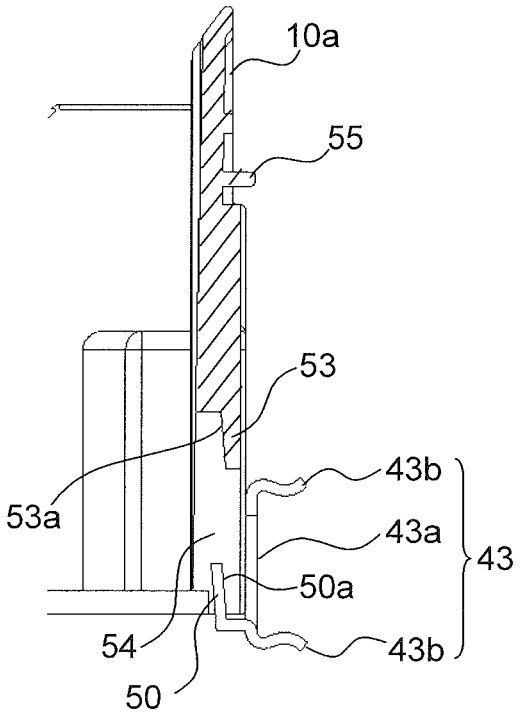
FIG. 12 is a sectional view of the side surface of the cassette base when fitting between a hook portion and the fitted portion has been released.

FIG. 12 is a sectional view of the side plate 10*a* of the cassette base 10 when fitting between the hook portion 50 and the fitted portion 53 has been released. As shown in FIG. 12, both the fitting surface 50*a* of the hook portion 50 and a fitted surface 53*a* of the fitted portion 53 are inclined surfaces inclined downward from above in such a direction as to approach the inner rail 43 (a rightward direction in FIG. 12). This makes it possible to smoothly release fitting between the hook portion 50 and the fitted portion 53 simply by lifting the paper feed cassette 1*a* upward, thus also facilitating an operation of mounting/demounting the cassette base 10 to/from the inner rail 43.

Other than the above, the present disclosure is not limited to the foregoing embodiment, and various modifications are possible without departing from the spirit of the disclosure. For example, while in the foregoing embodiment, the fitted portion 53 of the side plate 10*a* is provided at a position overlapping the pressing rib 55 in the insertion/withdrawal direction of the paper feed cassette 1*a*, the hook portion 50 and the fitted portion 53 may be disposed at any other position such as a middle portion of the inner rail 43 in the longitudinal direction. Furthermore, the hook portion 50 and the fitted portion 53 may be provided at each of two or more locations.

Furthermore, while the foregoing embodiment uses the slide rail 40 composed of the outer rail 41 and the inner rail 43, a configuration may also be adopted in which a middle rail is provided between the outer rail 41 and the inner rail 43 so that the slide rail 40 is extendable in three stages.

The present disclosure is usable for a sheet storage cassette having a cassette base in which a sheet-shaped recording medium is loaded and stored. By use of the present disclosure, it is possible to provide a sheet storage cassette and an image forming apparatus provided with the same, the sheet storage cassette capable of increasing, using simple configuration, strength of a side surface of the sheet storage cassette and thus effectively suppressing leaning of the side surface.

What is claimed is:

1. A sheet storage cassette insertable/withdrawable into/from a cassette housing portion, comprising:

a cassette base that has side plates facing each other parallel to insertion/withdrawal directions of the sheet storage cassette and stores a sheet therein; and inner rails that are mountable/demountable to/from the side plates of the cassette base and are slidably coupled to outer rails that are secured to the cassette housing portion, wherein the inner rails each includes:

positioning bosses that protrude from each of different positions on a side surface of the inner rails in a longitudinal direction thereof; and a hook portion that has an L-shape in cross section, is formed between the positioning bosses, and on the side surface of the inner rails, the cassette base includes:

mounting holes that are formed with respect to the positioning bosses on the side plates of the cassette base and receive the positioning bosses fitted thereinto at a time of mounting the cassette base to the inner rails;

positioning surfaces that are each provided on the side plates of the cassette base and, in a fitted state where the mounting holes and the positioning bosses are fitted together, comes into contact with two locations on each of the inner rails in a longitudinal direction thereof, thus performing positioning of the cassette base with respect to the inner rails in a direction orthogonal to the insertion/withdrawal direction; and a fitted portion that is provided on each of the side plates of the cassette base and is fitted together with the hook portion in the direction orthogonal to the insertion/withdrawal direction in the fitted state, the mounting holes are formed in an invert U shape, the mounting holes and the positioning bosses are fitted together by aligning, from above, the cassette base with the inner rail and inserting the positioning bosses into the mounting holes, the hook portion has a fitting surface that holds the fitted portion between itself and the inner rail, the fitted portion has a fitted surface that is substantially vertical and comes into contact with the fitting surface, the fitted surface is an inclined surface inclined downward in such a direction as to approach each of the inner rails, and the fitting surface is an inclined surface inclined upward in such a direction as to be separated from each of the inner rails.

2. The sheet storage cassette according to claim 1, wherein on each of the side plates of the sheet storage cassette, an opening portion into which the hook portion is to be inserted is provided on a lower side of the fitted portion, and the hook portion is fitted together with the fitted portion via the opening portion.

3. An image forming apparatus, comprising:

the sheet storage cassette according to claim 1;

a sheet feeder including:

the cassette housing portion; and a sheet feed unit that is provided in the cassette housing portion and separately feeds, one by one, the sheet stored in the sheet, storage cassette; and an image forming portion that forms an image on the sheet fed from the sheet feeder.

4. A sheet feeder, comprising:

a sheet storage cassette insertable/withdrawable into/from a cassette housing portion, comprising:

a cassette base that has side plates facing each other parallel to insertion/withdrawal directions of the sheet storage cassette and stores a sheet therein; and inner rails that are mountable/demountable to/from the side plates of the cassette base and are slidably coupled to outer rails that are secured to the cassette housing portion, wherein the inner rails each includes:

positioning bosses that protrude from each of different positions on a side surface of the inner rails in a longitudinal direction thereof; and a hook portion that has an L-shape in cross section, is formed between the positioning bosses, and on the side surface of the inner rails, the cassette base includes:

mounting holes that are formed with respect to the positioning bosses on the side plates of the cassette base and receive the positioning bosses fitted thereinto at a time of mounting the cassette base to the inner rails;

positioning surfaces that are each provided on the side plates of the cassette base and, in a fitted state where the mounting holes and the positioning bosses are fitted together, comes into contact with two locations on each of the inner rails in a longitudinal direction thereof, thus performing positioning of the cassette base with respect to the inner rails in a direction orthogonal to the insertion/withdrawal direction; and a fitted portion that is provided on each of the side plates of the cassette base and is fitted together with the hook portion in the direction orthogonal to the insertion/withdrawal direction in the fitted state;

the cassette housing portion into/from which the sheet storage cassette is insertable/withdrawable;

the cassette housing portion including:

a feed roller that feeds the sheet stored in the sheet storage cassette;

a retard roller that is contactable/separable with/from the feed roller; and a retard lever that brings the retard roller into contact with the feed roller or separates the retard roller from the feed roller; and a sheet feed unit that separately feeds, one by one, the sheet stored in the sheet storage cassette, wherein on the side surface of the sheet, storage cassette, a pressing rib is provided that presses the retard lever in a state where the sheet storage cassette is inserted into the cassette housing portion, and the fitted portion is provided at a position overlapping the pressing rib in the insertion/withdrawal directions.

5. An image forming apparatus, comprising:

the sheet feeder according to claim 4; and an image forming portion that forms an image on the sheet fed from the sheet feeder.

* * * * *